US007665222B2

(12) United States Patent
Dall'Aglio

(10) Patent No.: US 7,665,222 B2
(45) Date of Patent: Feb. 23, 2010

(54) GAUGE FOR CHECKING RADIAL DIMENSIONS OF MECHANICAL PIECES

(75) Inventor: Carlo Dall'Aglio, Castello D'Argile (IT)

(73) Assignee: Marposs Societa' per Azioni, Bentivoglio (BO) (IT)

( * ) Notice: Subject to any disclaimer, the term of this patent is extended or adjusted under 35 U.S.C. 154(b) by 0 days.

(21) Appl. No.: 12/224,090

(22) PCT Filed: Feb. 13, 2007

(86) PCT No.: PCT/EP2007/051405

§ 371 (c)(1),
(2), (4) Date: Aug. 18, 2008

(87) PCT Pub. No.: WO2007/093606

PCT Pub. Date: Aug. 23, 2007

(65) Prior Publication Data

US 2009/0013551 A1 Jan. 15, 2009

(30) Foreign Application Priority Data

Feb. 16, 2006 (IT) ..... BO2006A0118

(51) Int. Cl.
*G01B 5/08* (2006.01)
*G01B 3/38* (2006.01)

(52) U.S. Cl. ..... 33/558; 33/555.3

(58) Field of Classification Search ..... 33/556–561, 33/551–555, 555.1, 555.2, 555.3, 605, 657, 33/702, 706

See application file for complete search history.

(56) References Cited

U.S. PATENT DOCUMENTS

| | | | | |
|---|---|---|---|---|
| 4,637,144 | A * | 1/1987 | Schemel | 33/550 |
| 5,150,545 | A | 9/1992 | Esteve | |
| 5,542,188 | A * | 8/1996 | Ertl et al. | 33/605 |
| 5,761,821 | A * | 6/1998 | Laycock | 33/555.1 |
| 6,067,721 | A * | 5/2000 | Dall'Aglio et al. | 33/555.1 |
| 6,298,571 | B1 * | 10/2001 | Dall'Aglio et al. | 33/555.1 |
| 6,430,832 | B1 * | 8/2002 | Dall'Aglio et al. | 33/555.1 |
| 6,643,943 | B2 * | 11/2003 | Dall'Aglio et al. | 33/555.3 |
| 6,848,190 | B2 * | 2/2005 | Dall'Aglio et al. | 33/555.3 |

(Continued)

FOREIGN PATENT DOCUMENTS

| | | |
|---|---|---|
| EP | 0 382 336 | 8/1990 |

(Continued)

*Primary Examiner*—Yaritza Guadalupe-McCall
(74) *Attorney, Agent, or Firm*—Dickstein Shapiro LLP

(57) ABSTRACT

A gauge (1) for checking radial dimensions of a workpiece (60), e.g. the diameter of a crankpin orbitally rotating during grinding operations, includes a casing, a V-shaped reference device (4) and a rod that can move within the casing (2) with respect to the reference device, an end of the rod projecting from the casing and carrying a feeler (20) for touching the surface of the workpiece to be checked and transmitting the movements of the feeler to a transducer (22). A sealing system for preventing coolant, dust or other foreign matter from getting inside the casing includes a pneumatic conduit (6) for allowing compressed air to be blown from inside the casing to outside, and an internal seal that—in the non-operative condition—seals the opening through which the rod projects from the casing. According to an advantageous embodiment, the seal is fastened into a bushing guiding the rod and cooperates with a surface of the rod in order to get the tightness.

20 Claims, 5 Drawing Sheets

U.S. PATENT DOCUMENTS

| | | | | |
|---|---|---|---|---|
| 6,901,676 | B1 * | 6/2005 | Macke | 33/550 |
| 6,931,749 | B2 * | 8/2005 | Dall'Aglio | 33/555.3 |
| 6,955,583 | B2 * | 10/2005 | Dall'Aglio | 33/555.3 |
| 7,020,974 | B2 * | 4/2006 | Danielli et al. | 33/555.3 |
| 7,024,785 | B2 * | 4/2006 | Dall'Aglio et al. | 33/555.3 |
| 7,325,324 | B2 * | 2/2008 | Dall'Aglio et al. | 33/555.3 |
| 7,464,482 | B2 * | 12/2008 | Dall'Aglio et al. | 33/555.3 |
| 2002/0020075 | A1 * | 2/2002 | Dall'Aglio et al. | 33/555.1 |
| 2002/0166252 | A1 * | 11/2002 | Dall'Aglio et al. | 33/555.3 |
| 2003/0009895 | A1 * | 1/2003 | Dall'Aglio | 33/555.3 |
| 2004/0045181 | A1 * | 3/2004 | Dall'Aglio et al. | 33/555.3 |
| 2005/0178018 | A1 * | 8/2005 | Dall'Aglio et al. | 33/555.3 |
| 2007/0039196 | A1 * | 2/2007 | Dall'Aglio et al. | 33/555.3 |
| 2008/0155848 | A1 * | 7/2008 | Dall'Aglio et al. | 33/555.3 |
| 2009/0113736 | A1 * | 5/2009 | Dall'Aglio et al. | 33/555.3 |

FOREIGN PATENT DOCUMENTS

| | | |
|---|---|---|
| EP | 0 469 439 | 2/1992 |
| WO | WO 97/12724 | 4/1997 |

* cited by examiner

GAUGE FOR CHECKING RADIAL DIMENSIONS OF MECHANICAL PIECES

TECHNICAL FIELD

The present invention refers to a gauge for checking radial dimensions of a workpiece featuring a cylindrical surface, including a casing, a V-shaped reference device, coupled to the casing, adapted for cooperating with the cylindrical surface of the workpiece, a feeler adapted for touching the cylindrical surface of the workpiece and performing substantially linear displacements, a transmission element, movably arranged in the casing and carrying the feeler, a transducer adapted for providing signals indicative of the position of the feeler with respect to the V-shaped reference device, the transducer including a movable element coupled to the transmission element, and a sealing system between the transmission element and the casing.

BACKGROUND ART

Gauges having the above-mentioned features are known in the art. An example is shown in International patent application published with n. WO-A-9712724 that refers to a specific apparatus, for checking the diameter of crankpins during their orbital motion about a geometric axis. The gauge—that is part of the apparatus and is shown in FIGS. 6 and 7 of the international application—includes a V-shaped reference device that rests on the pin to be checked and a tubular guide casing. A transmission rod axially translates in the guide casing and carries a feeler that contacts the surface of the crankpin to be checked. The displacements of the rod are detected by a measuring device with an inductive transducer that includes a first part integral with the tubular casing and a second part integral to and movable with the transmission rod.

In the specific application that is shown in the above-mentioned international patent application, for checking a crankshaft being worked on a grinding machine, the fixed part of the gauge—including the tubular casing, the V-shaped reference device and a part of the inductive transducer—is coupled to a support system allowing the whole gauge to perform the displacements that are needed to keep the contact with the pin to be checked while the latter orbitally moves.

The tubular casing has an opening through which the end of the transmission rod carrying the feeler projects. A sealing device closes such opening in order to prevent coolant and other foreign matter that is present in the working environment from getting into the casing. More specifically, the sealing device is made up of a metal bellows having its ends fixed to the rod and the casing, respectively, that has also the function of preventing axial rotations between rod and casing, so preventing the feeler from undertaking improper angular positions.

As an alternative, known gauges include tubular external gaskets of different shape and/or material, e.g. made of rubber, arranged between the casing and the movable element carrying the feeler. These gaskets perform a sealing action but have no substantial role as far as anti-rotation is concerned.

The increasing demand for internal combustion engines featuring the utmost compactness leads to the production of components having smaller and smaller dimensions. One of such components is the crankshaft, that requires extremely accurate dimensional checkings.

It can be hard or impossible to use the apparatus shown in the above cited patent publication WO-A-9712724 for checking crankshafts featuring very small nominal dimensions. For instance, in case that the crankpin to be checked has extremely small length, it is necessary that consequently small be the thickness of the part of the gauge including the V-shaped reference device, the feeler, the corresponding ends of the rod and of the casing, and the sealing system. In fact such part of the gauge, during the checking operations, must be in touch with or very close to the surface of the pin, i.e. has to be arranged between the walls of the mutually facing cheeks at the ends of the pin. It is especially troublesome to reduce the dimensions of the sealing system when the available allowance is less e.g. than 8-10 mm. In fact, it is problematic to get metal bellows or different tubular gaskets featuring suitable transversal size, safe connection to both the mutually movable parts and right properties ensuring the needed characteristics as regards compliance and tightness.

DISCLOSURE OF THE INVENTION

Object of the present invention is providing a gauge that, while guaranteeing excellent performances in checking radial dimensions of mechanical parts, features small overall dimensions, so overcoming the problems of the known gauges in applications with limited allowance to the parts to be checked.

This object is reached by a gauge as defined above, wherein the sealing system includes a pneumatic conduit through which compressed air is blown from inside the casing to outside.

In a gauge according to the invention external tubular gaskets or metal bellows can be omitted, so allowing—by properly dimensioning the other components—to perform checking operations even where the access has very small dimensions. An exemplary application is the previously described one, where an orbitally movable crankpin having limited axial dimensions is checked, and the pin's dimensions and/or other mechanical parts of the application prevent components having transversal size bigger than 8-10 mm from being used.

A particular embodiment of the present invention features also an internal seal that is substantially fastened to either the casing or the transmission rod, and allows to guarantee a very good tightness to foreign matter even in a non-operative condition of the gauge. In this embodiment, consumption of the compressed air can be positively limited, since the air has not to keep flowing in the non-operative condition.

BRIEF DESCRIPTION OF THE DRAWINGS

The invention is now described in detail with reference to a preferred embodiment that is shown in the enclosed drawings, to be considered illustrative and not limitative, wherein.

BEST MODE FOR CARRYING OUT THE INVENTION

Figure 1:
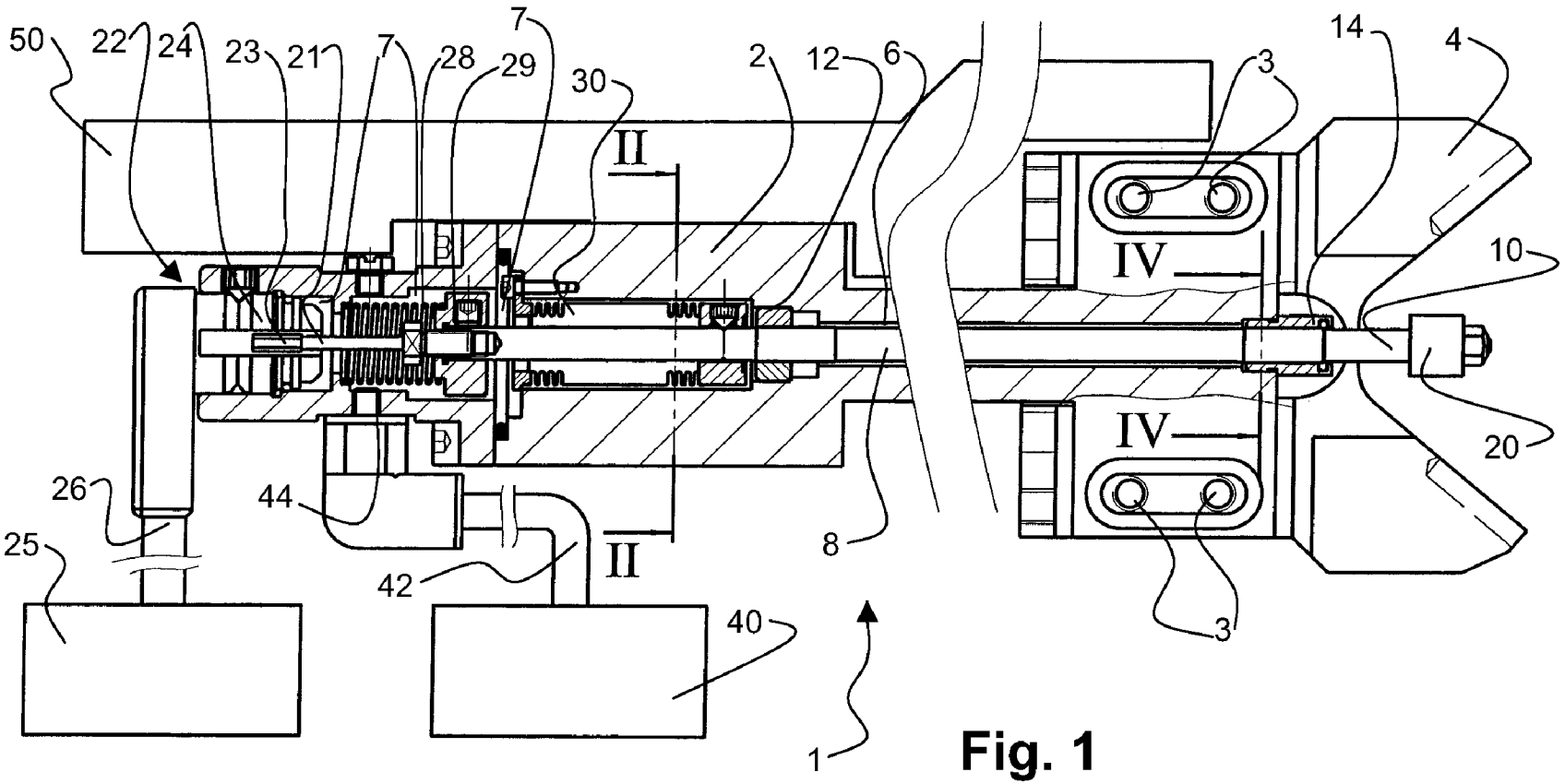
FIG. 1 is a longitudinal cross-section of a gauge according to a preferred embodiment of the invention, where some elements are not cutaway.

The figures show a gauge 1 for checking radial dimensions of mechanical pieces, according to the invention, more specifically a so-called "snap gauge". The gauge 1 includes a support system with a casing 2 having a long and narrow shape, and a V-shaped reference device 4 adjustably coupled to an end of the casing 2, e.g. by means of screws that, in FIG. 1, are schematically shown and indicated by reference number 3. The V-shaped reference device 4 includes a couple of contact surfaces forming an angle and adapted to rest on a surface of a workpiece to be checked. The casing 2 has a through axial opening 6 where a rod 8 is housed and can longitudinally translate guided by guide devices with a first bushing 12 and a second bushing 14. An end portion 10 of rod 8 has reduced diametral dimensions and projects from the casing 2 at an end of the axial opening 6 in correspondence of the V-shaped reference device 4. Towards the opposed end, the axial opening 6 defines an enlarged zone 7 featuring sections with different diametral dimensions. A feeler 20, adapted for touching the surface of a workpiece to be checked and performing substantially linear displacements, as is explained hereinafter, is fixed to the end portion 10 of rod 8, and a movable element or core 23 of an inductive transducer 22 is coupled to the opposite end of rod 8 through a stem 21. The transducer 22 also includes a fixed part 24, coupled to the casing 2 at the above-mentioned enlarged zone 7 of the axial opening 6, having windings in which core 23 can translate. The windings—that are not shown in FIG. 1—are coupled, through electric wires of a cable 26, to a processing and display unit of a known type, that is schematically shown in FIG. 1 and indicated by number 25.

The rod 8 is a transmission element transmitting substantially linear displacements of the feeler 20—displacements that are a consequence of the contact with a surface of the workpiece to be checked—to the core 23 of the transducer 22.

Thrust devices include a compression spring 28 applying an axial thrust between the rod 8 and surfaces of the enlarged zone 7 of the axial opening 6 by acting, in the example of FIG. 1, on a flange 29 fastened to rod 8 and pushing towards the outside the end portion 10 carrying the feeler 20.

Figure 4:
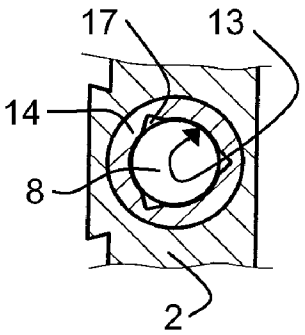
FIG. 4 is a transversal cross-section of the gauge of FIG. 1, taken along the line IV-IV of FIG. 1.
Figure 5:
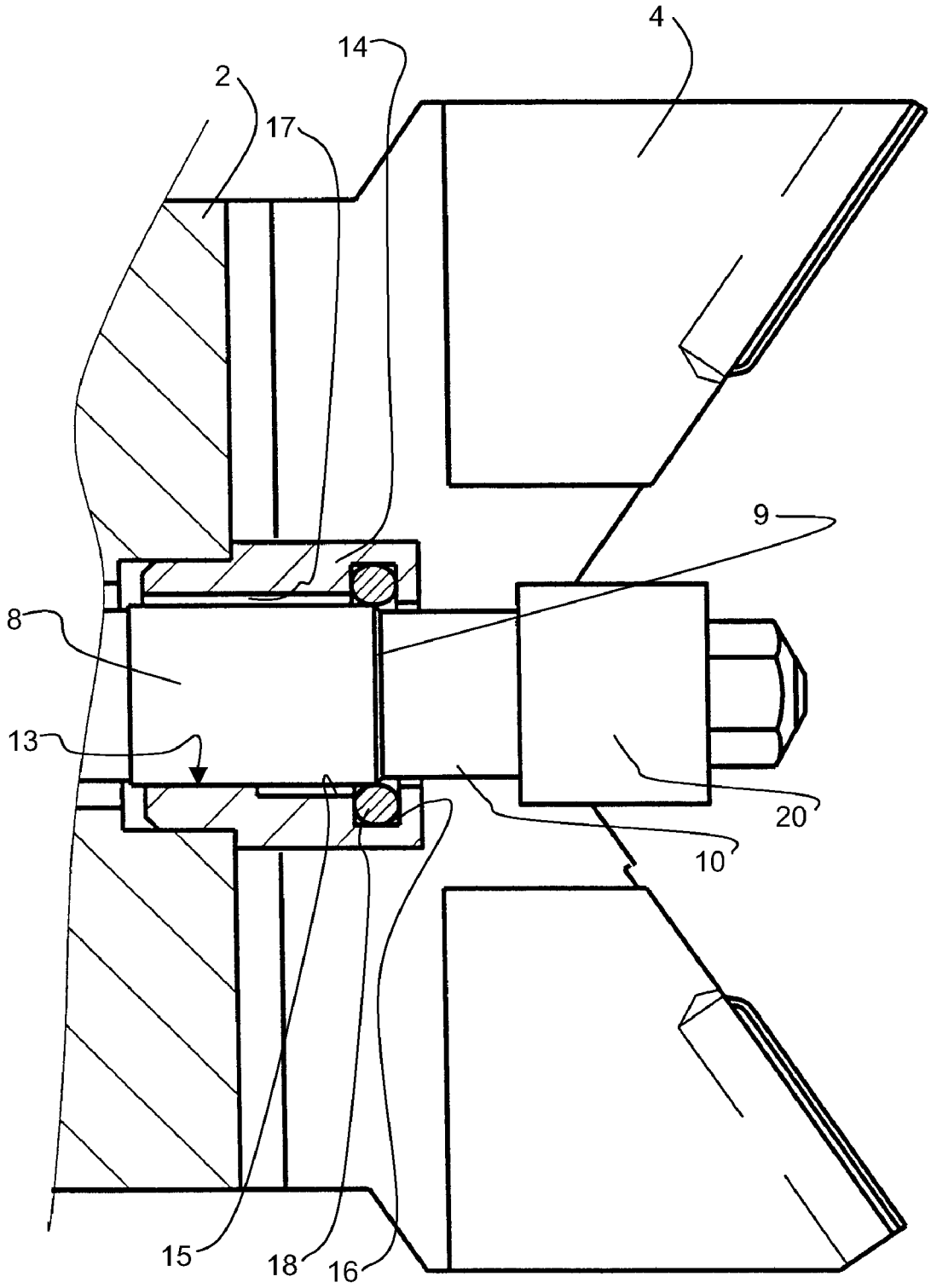
FIGS. 5 and 6 are longitudinal cross-sections, according to an enlarged scale and with some components simplified for reasons of clarity, of a detail of the gauge of FIG. 1, at a non-operative and an operative position, respectively.
Figure 6:
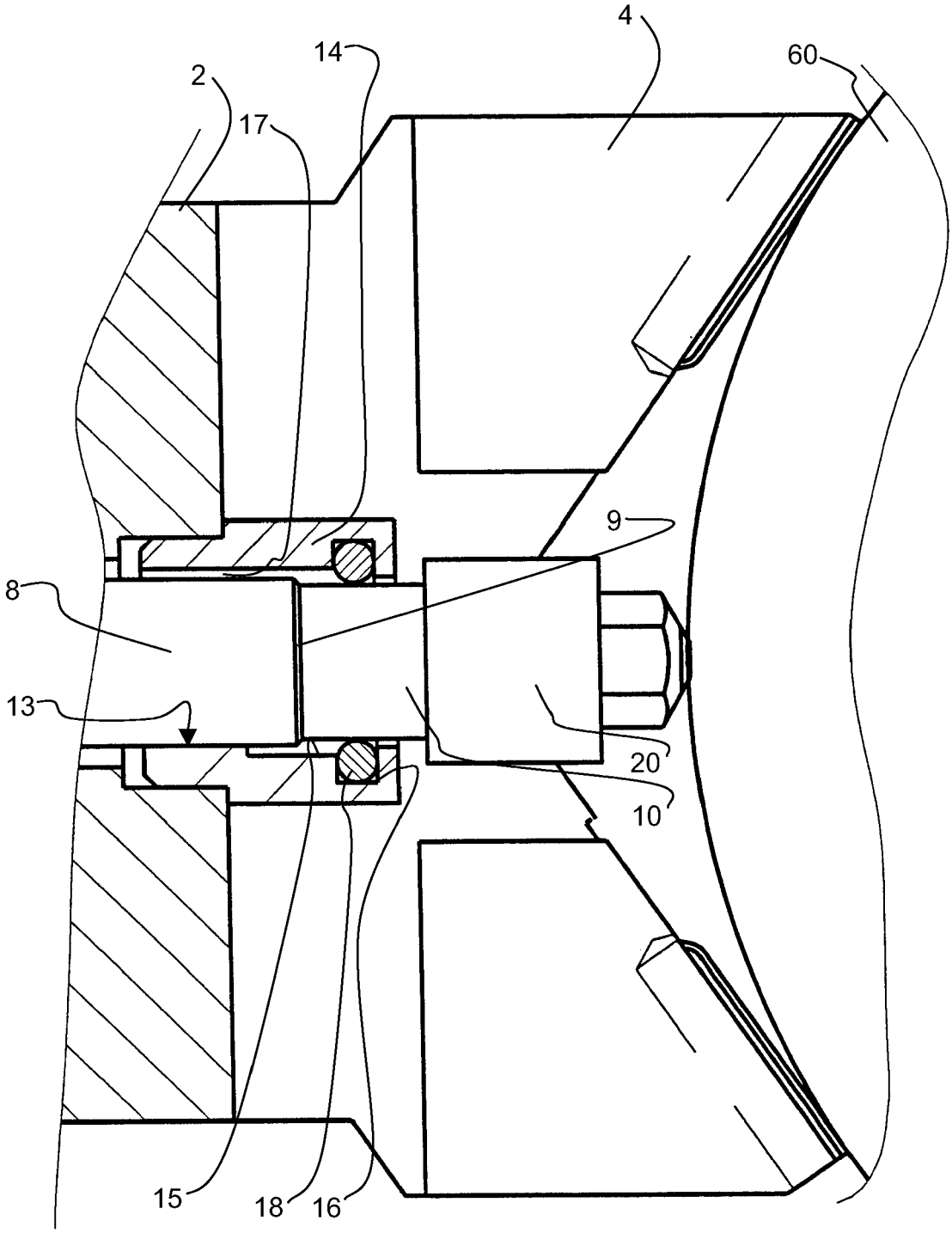

The second bushing 14, arranged nearby the V-shaped reference device 4 and shown more in detail in FIGS. 4, 5 and 6, includes a guide portion 13 guiding longitudinal translation movements of rod 8 and an enlarged portion 15 having internal surface with wider diametral dimensions, where a circular cavity 16 is defined. A sealing element includes an annular internal seal 18, e.g. a so-called "O-Ring", that is coupled to the casing 2, more specifically it is partially housed in circular cavity 16 of the second bushing 14.

The annular seal 18 protrudes from the internal surface of the second bushing 14 and cooperates with a matching surface of rod 8, substantially near a union zone 9 of the latter, adjacent to the end portion 10 having reduced diametral dimensions.

The guide portion 13 includes three additional openings, more specifically longitudinal cuts 17, angularly spaced at 120 degrees from one another, that allow the compressed air to flow.

An antirotation device with a metal bellows 30 has the ends fastened to rod 8 and casing 2 and is housed in the enlarged zone 7 of the axial opening 6. Metal bellows 30 has only the task to substantially prevent mutual axial rotation between rod 8 and casing 2.

Figure 3:
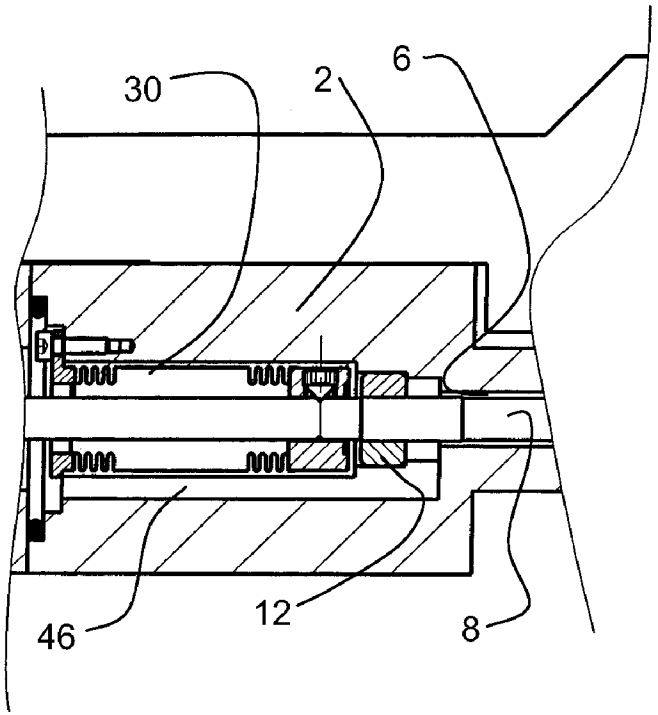
FIG. 3 is a scrap longitudinal cross-section of the gauge of FIGS. 1 and 2, taken along the line III-III of FIG. 2.
Figure 2:
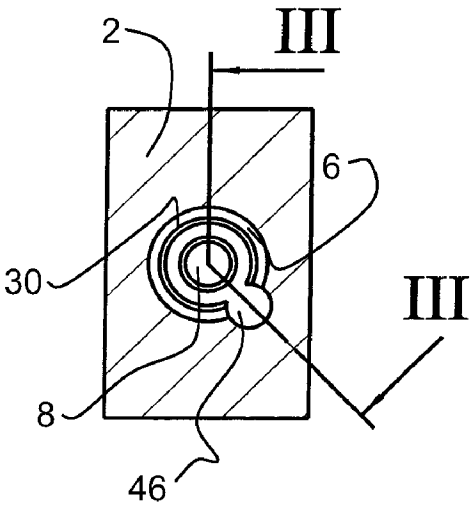
FIG. 2 is a transversal cross-section of the gauge of FIG. 1, taken along the line II-II of FIG. 1.

A source of compressed air, schematically shown in the figure and referred to with number 40, is coupled through a hose 42 to a lateral through hole 44 of casing 2 putting the enlarged zone 7 of the axial opening 6 in communication with the outside. A crossing hole 46—which can be seen in FIGS. 2 and 3—is defined in casing 2 between the above-mentioned enlarged zone 7 and an intermediate zone of the axial opening 6 between the first bushing 12 and the second bushing 14. The crossing hole 46 and parts of the axial opening 6 so define a pneumatic conduit for allowing the passage—within casing 2 and towards the opening at the V-shaped reference device 4—of the compressed air provided by source 40. Through the pneumatic conduit the compressed air can be blown from inside the casing 2 to outside. The snap gauge 1 can be fastened to an external support, schematically shown in FIG. 1 and referred to by reference number 50, e.g. by means of a movable structure similar to the one that is described and shown in the above-cited patent publication WO-A-9712724, and that is part of an application for checking orbitally rotating crankpins.

In non-operative conditions the rod 8 is arranged, under the thrust of spring 28, in the position shown in FIGS. 1 and 5. Such position is defined by limiting devices that are known and not shown in the figures and include mechanical abutments that are pushed against one another by the thrust of the spring 28. Near the union zone 9, the matching surface of rod 8 is pushed against the annular seal 18, so guaranteeing gauge 1 be sealed. In other words, the opening 6 is closed and any fluids or other foreign matter cannot access inside the casing 2.

Figure 7:
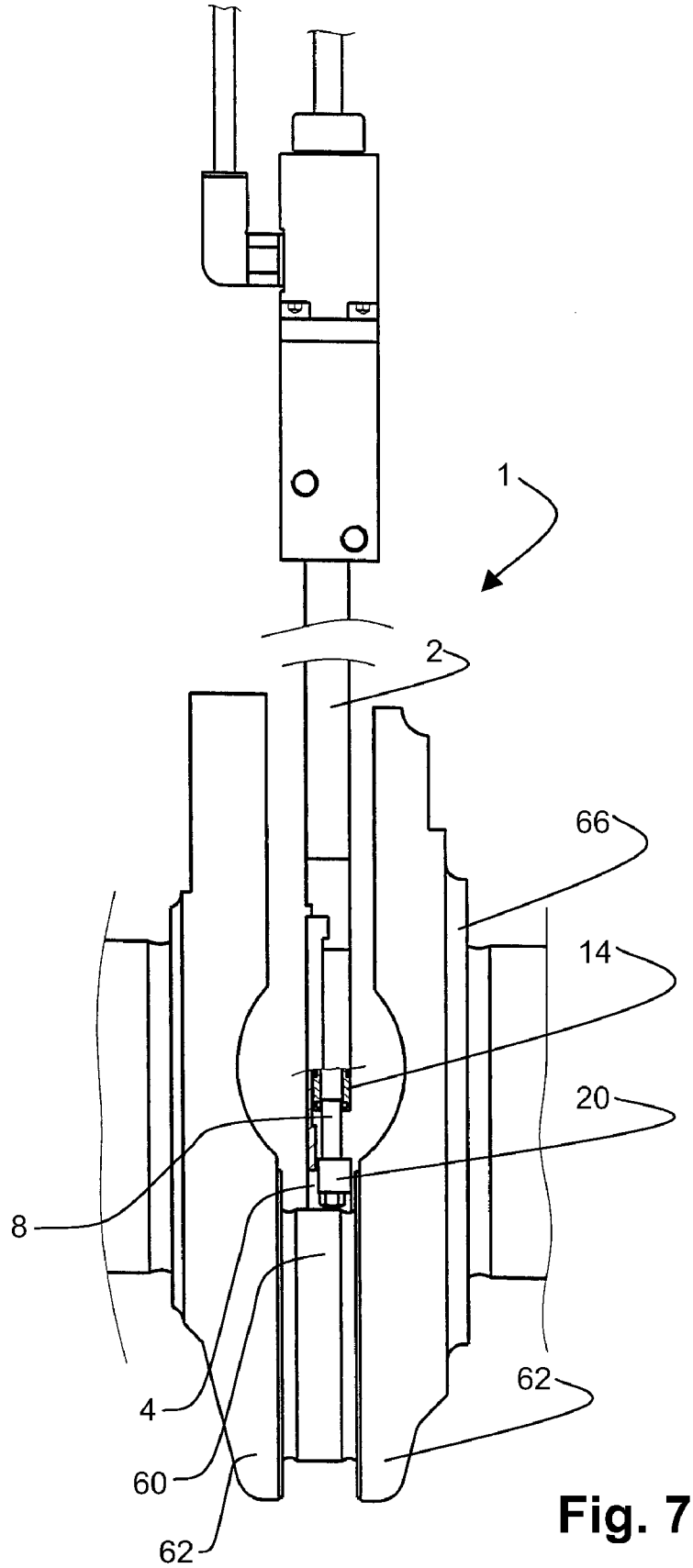
FIG. 7 is a lateral view of the gauge of FIG. 1, where some details are cross-sectioned, during the checking of a crankpin of a crankshaft.

In order to perform checking operations the gauge 1 is brought, manually or automatically, to contact a cylindrical surface of the workpiece 60 to be checked, for instance a crankpin of a crankshaft 66 that is partially and schematically shown in FIG. 7, laying between cheeks 62. The V-shaped reference device 4 comes into contact with the surface of workpiece 60 (FIG. 6) and, according to the cited example, keeps in contact with such surface during the orbital rotations of the workpiece 60, e.g. thanks to the action of the force of gravity (on this regard, reference is made to the description of the above-cited patent publication WO-A-9712724).

A thrust opposite to the one of spring 28 is applied to the feeler 20, and consequent movements of feeler 20 are transmitted by the rod 8 to the core 23 of the transducer 22. The latter provides signals indicative of the position of the feeler 20 with respect to the V-shaped reference device 4 to the processing and display unit 25 which processes the signals and provides indications about the dimensions of workpiece 60. When the gauge is applied in an "in-process" checking on a machine tool (more specifically a grinding machine), such indications can be used for controlling the grinding operation of crankshaft 66. Compressed air that is provided by the source 40 and is blown inside the casing 2 through lateral hole 44, longitudinally crosses the casing 2 in the pneumatic conduit defined by the crossing hole 46, clearances in the axial opening 6, the longitudinal cuts 17 and enlarged portion 15 of second bushing 14. When, following the contact between feeler 20 and surface of workpiece 60, the matching surface of rod 8 moves far from seal 18, the air can get outside. The compressed air flowing outside blows off and prevents foreign matter—possibly standing near the contact area between feeler 20 and workpiece 60—from getting inside the casing 2, so achieving a sealing system. The tightness is particularly important in "in-process" applications where the piece being worked in a machine tool is struck and covered by coolant, and would the latter get inside the casing 2, it might negatively affect the working of the gauge 1 and damage its components, among them the transducer 22.

When the gauge 1 is moved away from the workpiece 60, the spring 28 pushes back the matching surface of rod 8 against the seal 18, so sealing opening 6. As a consequence, the air coming from source 40 remains, under pressure, within casing 2. In such a way, the waste of air is advantageously limited to those phases of the checking when the feeler 20 moves. As an alternative, the provision of compressed air can be interrupted in the non-operative condition.

The gauge 1 according to the present invention can guarantee excellent tightness without external sealing devices such as rubber or metal tubular gaskets that, in order to ensure the required performances, cannot have very small size. Thanks to the possibility of omitting external gaskets, it is possible to obtain gauges where the parts that come into engagement with the workpiece to be checked have very small transversal dimensions. As a consequence, it is possible to provide applications for checking parts featuring limited accessibility, such as crankpins that are longitudinally delimited by two mechanical parts very close to each other (e.g. 8-10 mm), as schematically shown in FIG. 7.

Moreover, internal seal 18 guarantees the tightness in the non-operative condition of the gauge 1, when the gauge 1 stands in a retracted position with respect to the piece to be checked, or is stored, for instance, in a storage magazine. In fact, even though the non-operative condition is less critical, it would be necessary to heavily increase the consumption of compressed air in order to prevent dust or other foreign matter from settling at the entrance of the casing 2 and getting inside. Internal seal 18 allows to keep compressed air within the casing 2 and/or to interrupt the generation of air when gauge 1 must not perform any checking operations, and this does not jeopardize the proper seal of the gauge 1.

Gauges according to the present invention can feature different embodiments with respect to what is shown in the figures and is described above.

The tightness at the second bushing 14 can be carried out in a different way, where, for instance, seal 18 or an element having similar features is coupled to and movable with a suitable area of the rod 8, while the internal surface of bushing 14 is suitably shaped in order to define a matching surface matching with the seal and providing sealing in the non-operative condition of gauge 1.

The thrust devices, too, can have different embodiments and include mechanisms having different shape and arrangement, e.g. with magnetic elements.

The guide devices can include other guiding elements, for instance a ball bushing, in the place of the first bushing 12, or include a single element, e.g. substantially corresponding to the second bushing 14, suitably dimensioned.

Embodiments of the present invention may also differ as regards the arrangement of the translation direction of the rod 8 with respect to the angle formed by the contact surfaces of the V-shaped reference device 4. More specifically, the translation direction of the rod 8 carrying the feeler 20 may be substantially aligned along the bisecting line of the above-mentioned angle, or may be slightly inclined with respect to it.

Moreover, inductive transducer 22 can be replaced by an axial gauging head having a movable part in contact with an end surface of rod 8, substantially as shown in FIGS. 6 and 7 of the already cited patent publication WO-A-9712724. Other known types of transducers can be employed (e.g. optical). In any case, it is advantageous to make use of a pneumatic device for obtaining the tightness, that is independent from the circuit for detecting the movements of feeler 20. Keeping the two circuits independent from each other allows on the one hand to choose the transducer on the basis of the specific application involved, in order to obtain the best metrological performances, on the other hand to get the above-mentioned pneumatic sealing circuit in an extremely simple and cheap way. In fact, this pneumatic circuit does not require, for instance, stabilizers to control the pressure value, but, on the contrary, it can make use of the air that is normally available for other tasks in the workshop environment ("factory air").

Moreover, a gauge according to the present invention can be fastened to different types of external supports or used, e.g. manually, as a stand alone apparatus.

The invention claimed is:

1. A gauge for checking radial dimensions of a workpiece having a cylindrical surface, said gauge comprising:

a casing, a V-shaped reference device, coupled to the casing, adapted for cooperating with the cylindrical surface of the workpiece, a feeler adapted for touching the cylindrical surface of the workpiece and performing substantially linear displacements, a transmission element, movably arranged in the casing and carrying said feeler, a transducer adapted for providing signals indicative of a position of the feeler with respect to the V-shaped reference device, the transducer having a movable element coupled to the transmission element, and a sealing system between the transmission element and the casing, having a pneumatic conduit through which compressed air can be blown from inside the casing to outside.

2. A gauge according to claim 1, wherein the sealing system further comprises a sealing element in contact with one of said casing and transmission element and adapted to cooperate with a corresponding surface of the other one of said casing and transmission element.

3. A gauge according to claim 2, further comprising thrust devices adapted to apply an axial thrust to the transmission element, said axial thrust being adapted to keep mutual contact between said sealing element and said corresponding surface.

4. A gauge according to claim 3, wherein said thrust devices include a spring arranged between the casing and the transmission element.

5. A gauge according to claim 2, wherein the transmission element comprises a rod, the casing defining an axial opening, said rod being housed and axially movable in the axial opening.

6. A gauge according to claim 5, wherein said pneumatic conduit comprises at least a part of said axial opening.

7. A gauge according to claim 6, further comprising guide devices adapted to guide translation movements of said rod along a translation direction in the axial opening, the guide devices including at least one bushing coupled to the casing near the V-shaped reference device, the pneumatic conduit further comprising at least one opening of said at least one bushing.

8. A gauge according to claim 7, wherein said at least one bushing defines an internal surface and the sealing element is coupled to said internal surface, the rod defining said corresponding surface.

9. A gauge according to claim 7, wherein said V-shaped reference device defines contact surfaces forming an angle, said translation direction of the rod being arranged substantially aligned along a bisecting line of said angle.

10. A gauge according to claim 2, wherein the sealing element includes an annular seal.

11. A gauge according to claim 1, wherein the transducer includes a fixed part coupled to the casing.

12. A gauge according to claim 11, wherein the transducer is an inductive transducer.

13. A gauge according to claim 1, including an antirotation device having a metal bellows housed in the casing and fixed to the transmission element and the casing.

14. A method for using a gauge according to claim 1, wherein, during the checking operation, the mechanical workpiece is orbitally rotating and the V-shaped reference device keeps in contact with the cylindrical surface of the workpiece.

15. The method according to claim 14, for checking a crankpin of a crankshaft during grinding operations on a machine tool.

16. A method for checking radial dimensions of a workpiece having a cylindrical surface, comprising:

providing a gauge comprising a casing, a V-shaped reference device coupled to the casing and adapted for cooperating with the cylindrical surface of the workpiece, a transmission element movably arranged in the casing, and a sealing system between the transmission element and the casing, the sealing system having a pneumatic conduit through which compressed air is blown from inside the casing to outside;

bringing the V-shaped reference device into contact with the cylindrical surface of the workpiece; and checking radial dimensions of the workpiece.

17. The method according to claim 16, wherein said checking radial dimensions of the workpiece comprises checking a crankpin of a crankshaft during grinding operations on a machine tool.

18. The method of claim 16, wherein said providing said gauge further comprises providing a feeler adapted for touching the cylindrical surface of the workpiece and performing substantially linear displacements.

19. The method of claim 18, wherein said providing said gauge further comprises providing said feeler being carried by said transmission element.

20. The method according to claim 19, wherein said providing said gauge further comprises providing a transducer adapted for providing signals indicative of a position of the feeler with respect to the V-shaped reference device, the transducer having a movable element coupled to the transmission element.

* * * * *